United States Patent [19]

Chang

[11] 4,067,370

[45] Jan. 10, 1978

[54] AUTOMATIC PLANK PLANING MACHINE

[76] Inventor: Chen-Wan Chang, 453, Feng Shih Road, Feng Yuan Chen Taichung, Hsien, China /Taiwan

[21] Appl. No.: 733,283

[22] Filed: Oct. 18, 1976

[51] Int. Cl.[2] ..... B27C 1/12

[52] U.S. Cl. ..... 144/117 R; 144/246 R; 144/246 D; 198/624; 226/176; 226/187

[58] Field of Search ..... 198/624; 226/176, 177, 226/187; 144/114 R, 117 R, 136 R, 2 R, 246 R, 246 D, 247, 248, 2 R

[56] References Cited

U.S. PATENT DOCUMENTS

| | | | |
|---|---|---|---|
| 1,109,747 | 9/1914 | Giertsen | 144/246 R |
| 1,486,288 | 3/1924 | Forsyth | 144/117 R |
| 1,736,641 | 11/1929 | Zimmerman | 144/117 R |
| 2,649,872 | 8/1953 | Miller | 144/117 R |
| 2,873,776 | 2/1959 | Buttke | 144/114 X |
| 3,425,612 | 2/1969 | Huber et al. | 226/177 |

*Primary Examiner*—Harrison L. Hinson
*Assistant Examiner*—W. D. Bray
*Attorney, Agent, or Firm*—Shoemaker and Mattare, Ltd.

[57] ABSTRACT

An automatic plank planing machine, and more particularly a planing machine wherein two feeding rollers are vertically movable to compensate for warp in planks to be planed in order to provide an accurate and smooth planing operation.

6 Claims, 6 Drawing Figures

AUTOMATIC PLANK PLANING MACHINE

BACKGROUND OF THE INVENTION

Conventional planing machines are generally of two types, the first type requiring planks to be fed past a revolving plane by hand. Although this type is the most accurate, due to the high rate of injuries to worker's hands, it is not in common use today in larger lumber yards. These machines generally consist of at least two sets of feeding rollers to feed a plank over and past a revolving plane at a constant speed. The rollers also serve to press the plank against the plane while at the same time they prevent the plank from being driven back by the plane or getting cocked at an angle. The main disadvantage of such machines is that most planks have a tendency to warp. When planks that have been warped are planed on these machines, the rollers serve to press the plank flat, whereupon it is planed and leaves the machine, whereupon, after being released from the pressure of the rollers, the plank will warp again to its original configuration.

The purpose of this invention is provided for a construction whereby the rollers of an automatic planing machine are movable so as to compensate for the warp in planks by following that natural warp, thereby allowing the plank to be planed in a manner that will result in a truly level, flat plank.

Other objects and advantages will be apparent as the invention is explained with reference to the appended drawings wherein.

Figure 1:
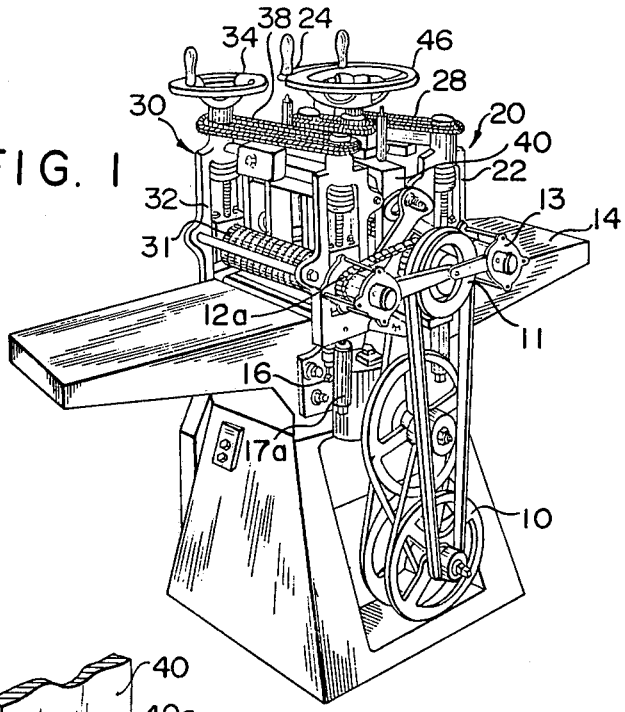
FIG. 1 is a perspective view of a preferred embodiment of an automatic planer built according to the present invention.
Figure 2:
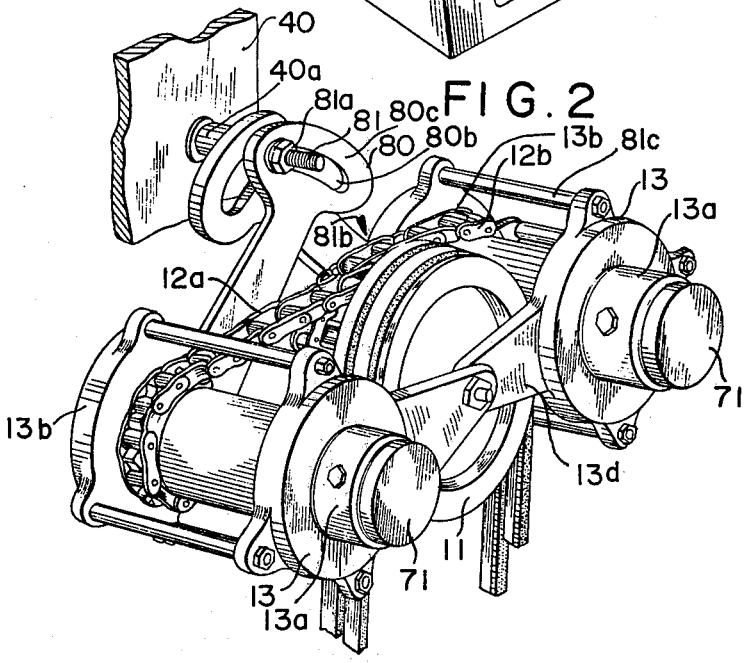
FIG. 2 is a perspective view of the drive arrangement thereof.
Figure 3:
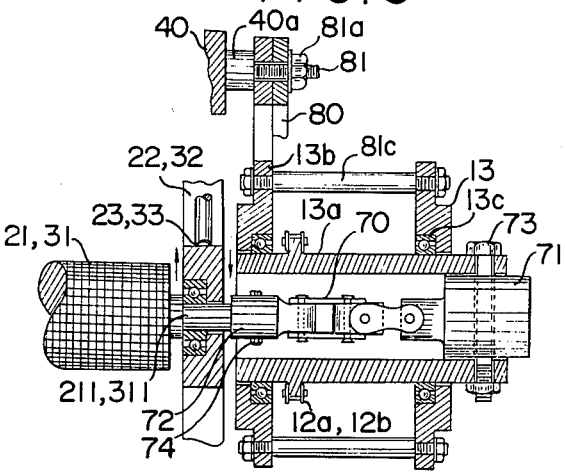
FIG. 3 is a view in partial cross section of the drive link to the rollers thereof.
Figure 4:
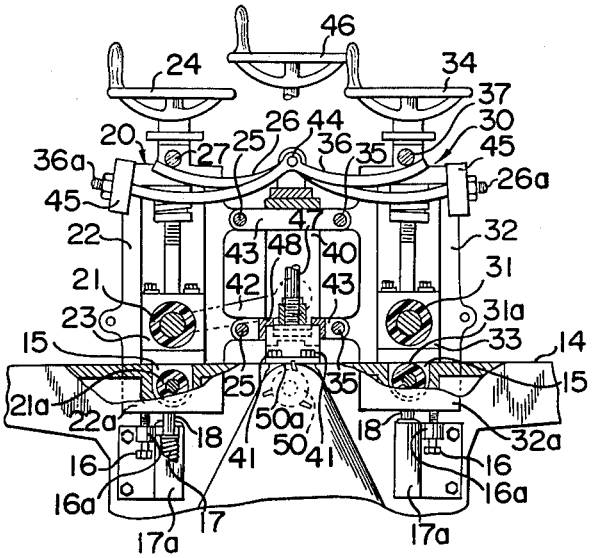
FIG. 4 is a view in cross section showing the arrangement of balance bars in accordance to the present invention.

As shown in FIGS. 1, 2 & 3 the machine according to the present invention is driven by a set of reduction motor pulleys and V-belts 10 driven by a suitable motor (not shown), in turn driving a drive wheel. Provided on the same shaft as is the drive wheel 11 is a sprocket gear which, by means of sprocket chains **12*a* and 12*b* separately drive shaft cylinders 13*a* provided in supports 13. Each shaft cylinder 13*a* is provided with a universal link 70, one end 72 being connected by means of a bolt 74 to a center rod 211, 311 of a conveying roller 21, 31, the other end 71 of said universal link 70 being secured to the shaft cylinder 13*a* by means of a bolt 73. The supports 13 are connected to an intermediate stationary base 40 by means of a nut 81*a*. In addition to the conveying rollers 21 and 31, roller housings 20 and 30 are each provided with a follower roller 21*a* and 31*a* respectively. The roller housings 20, 30 are connected to the planing table to be mounted perpendicular thereto. The housings stradle the table 14 and the follower rollers 21*a*, 31*a* are disposed in suitable troughs 15—15 defined in on the table 14** for this purpose.

Each rollerhousing 20, 30 is composed of a frame 22, 32 in which the conveyor roller 21, 31 is mounted by means of a shaft mounting block 23, 33. The shaft mounting blocks 23, 33 are laterally movable within the frame and adjustable by means of handwheels 24, 34 suitably connected to both the shaft mounting blocks 23, 33 and the housing frames 22, 32. The follower rollers **21*a*, 31*a* are mounted below the conveyer rollers 21, 31 and are stationary in relationship to the roller housing frames 22 and 32 respectively. Turning of one of the handwheels 24, 34 will cause a conveyer roller 21, 31 to move closer to or farther from the corresponding stationary follower roller 21*a*, 31*a* respectively. To prevent the rollers from moving inwardly towards the center when the rollers are moved up and down, the shaft cylinders are connected by a set of arms 80, and by a bolt 81 and secured thereto by means of a nut 81*a*. As shown in FIGS. 2 and 3, the link 70 is connected to shaft cylinder 13*a* at end 71 by bolt 73. The supports 13 and 13*b* are rotatably mounted on the shaft cylinder 13*a* by bearing means 13*c*. As shown in FIG. 2, supports 13 have arms 13*d* connected together by a fastener, and supports 13*b* have arms 80 thereon, as indicated at 81*b* in FIG. 2. The arms 80 are each pivotally connected to a stationary base 40 by bolt 81 which is inserted through crescent-shaped bolt receiving opening 80*b* defined in head 80*c* of the arm 80 with the nut 81*a* being threaded onto the bolt 81 and jamming the arm heads against abutment 40*a* to pivotally attach the arms to the support 40. Brace bolts 81*c* interconnect the supports 13 and 13*b*** to provide further support therefor.

Disposed between the two movable roller housings 20, 30 is stationary base 40 which is secured to the table 14 by means of machine screws 41—41. One outside wall of the stationary base 40 is provided with a set arm 42 which is further secured to the shaft block 23 to create a pull on the frame 22 of the movable roller housing 20 in order to prevent any undesirable shifting of the housing 20 to the left or right along the axis of the table 14. In addition, frame 22 is provided with rods 25—25 which are mounted in set bars 43—43. The pull bars 43—43 have mounted at the other ends thereof rods 35—35 which are provided in the frame 32 so that either housing may move up or down independently of the second housing, but neither housing is capable of shifting to the left or right.

The top of the stationary base 40 is provided with a pivot rod 44 which serves as the fulcrum for two balance bars 26 and 36. One end of the balance bar 26 will abut a post 27 provided at a suitable place on the movable roller housing 20 and one end of the balance bar 36 will abut a post 37 on the movable housing 30 in a like manner. The ends of the balance bars 26, 36 not in abutment with the movable roller housings 20, 30 are extended and are provided with suitable balance weights 45—45 so that the abutting end of each bar 26, 36 will maintain contact with the respective posts 27, 37 and cause upward force to be exerted upon the housings 20 and 30 respectively to increase the sensitivity of the housings to warped surfaces of planks being fed thereunder.

As stated hereinbefore, the movable roller housings 20, 30 are stradled over the table 14 with the following rollers **21*a*, 31*a* being accomodated in roller troughs 15 provided on the table 14. The housings are supported by adjustable set screws 16—16 which are secured to the body of the machine by flange plates 16*a*—16*a*. The exact height of the housings may be adjusted by means of these set screws 16—16. In addition to the set screws, a spring casing 17*a* may be provided on the machine body having a coil spring 17 disposed therein and a support post 18 extending therefrom to give the housings extra support. The springs 17—17 will supplement the function of the weights 45—45 on the balance bars 26, 36 as described above, therefore increasing the sensitivity with which the roller housings 20, 30** may follow the warp of a plank. The spring may also be an oil or air pressure chamber, with substantially the same result.

The stationary base member 40 is provided with a handwheel 46 and an adjustment rod 47 which is attached to a pressure plate base **47*a* and a plurality of pressure plates 48—48 are attached to a flange portion of the pressure plate base 47*a*. Between each pressure plate 48 and the pressure plate base 47*a* is disposed a cushion member 49 made from any suitable material, such as sponge, foam rubber and the like. The height of the pressure plates 48—48 may be adjusted by turning the handwheel 46. The pressure plates are disposed directly over a revolving planing device 50 disposed in a trough 50*a* provided in the table 14 for this purpose. Hereinafter, the portion of the table 14 located beneath the pressure plates, including the planing trough 50*a* and knives of the revolving planing device 50 will be referred to as the "planing area". The purpose of the pressure plates 48—48 is to insure that a plank does not get cocked upon coming into contact with the planing device 50 by exerting downward pressure thereon. However, due to the cushion members 49, the pressure plates 48—48** will be able to accomodate any warp in the board and will not cuase the warped portion to be pressed flat, but allow that portion to pass through the planing area as will be explained.

Figure 5:
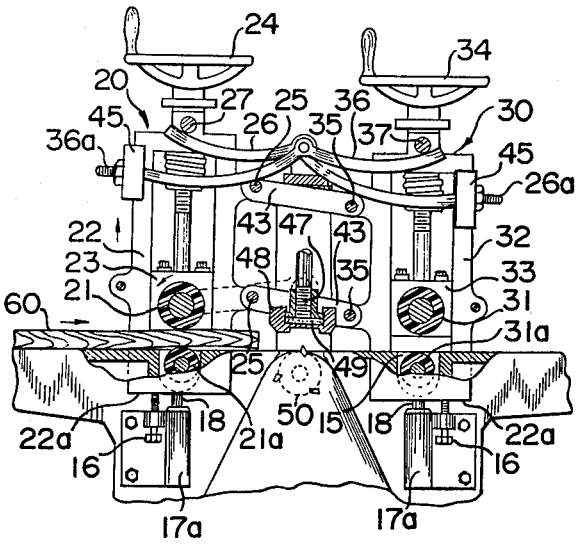
FIGS. 5 & 6 are two views showing movement of the feeding rollers in response to a warped plank being passed over the revolving planer.
Figure 6:
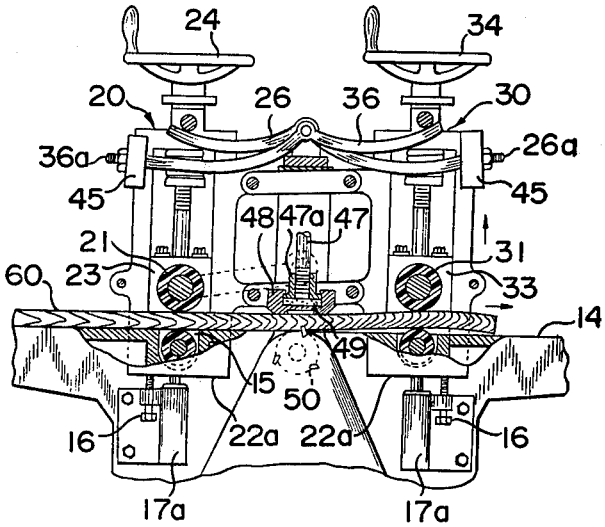

FIGS. 5 & 6 depict a plank 60 having a warped portion 60' being fed to and past the planing area in a machine constructed according to the present invention. After adjusting the conveyor rollers 21 and 31 and the pressure plates 48—48 to the desired height a plank 60 may be fed to the conveyor roller 21. The plank 60 is fed with its convex warp facing upwards and the resulting concave warp towards the table 14. As the roller 21 rotates, it will frictionally engage the plank 60 and cause it to move toward the planing area and the follower roller **21*a* will rotate in response to the movement of the plank 60. When the warped portion of the plank 60 passes between the conveyor roller 21 and the follower roller 21*a*, there will be produced an upward component of force causing the highly sensitive movable roller housing 20 to shift upwardly (see arrows in FIG. 5), so that without exerting excessive pressure on the warped portion of the plank 60 which would tend to cause the warp to flatten out, the rollers 21, 21*a* remain in frictional contact with the plank 60 and continue to feed it into the machine in a steady and stable manner. It will be noted here that as the roller 21 moves upwardly it must move vertically with no arched movement. To allow such movement the driving link 70 between the shaft cylinder 13*a* and the roller 21 is a universal joint as shown in FIG. 3. By the same principle as stated above, when the warp has all but passed through from between the rollers 21, 21*a*, the lower surface of the plank acting against the follower roller 21*a* produce a downward component of force and the movable roller housing 20 will travel vertically downward following the contour of the plank (see arrows in FIG. 6). As the plank 60 approaches the planing area it will first be engaged by the pressure plates 48—48. The pressure plates will exert enough pressure on the plank 60 so that as the leading edge thereof contacts the plane 50 which is revolving at high speed, the plank will not shift, slide, or otherwise get cocked. As the warped portion enters the planing area the warp will cause the pressure plates 48—48 to ride up due to the "give" of the elastic members. However, the pressure plates will still maintain enough pressure to prevent the plank from slipping. Due to the fact that the pressure plates do not press the plank flat, the warped portion will not come into contact with the plane 50. As the warp decreases, or as the plank continues to travel through the planing area, the bottom of the plank 60 will gradually come into contact again with the plane 50**.

In this way it is possible to plane a plank automatically, without deforming its natural warp during planing, which will be restored upon leaving the last rollers, but rather planes "around" the warp, so that after several passes through the planer a perfectly flat, straight plank of the same thickness throughout is produced.

What I claim is:

1. An automatic lumber planing machine comprising:
- a machine body;
- a planing table mounted on said machine body and having follower roller troughs defined therein;
- two movable roller housings, each movably mounted on said planing table to be disposed thereabove;
- conveyor rollers mounted on each of said roller housings;
- a follower roller mounted in each of said planing table follower roller troughs;
- adjustable set screws connecting said housings to said machine body;
- spring means mounted on said machine body and connected to each said housings;
- a stationary member secured to said machine body between said two roller housings;
- a horizontal rod mounted on each of said movable housings;
- two bars each having opposite ends and each being pivotally connected to said stationary member, each bar having a balance weight on one end thereof with the other end of said each bar being forced upwardly against said horizontal rod by said weight so that each roller housing can be moved upwardly to allow said conveyor roller to follow a natural warp of a plank being put through the planing machine, whereby the frictional driving engagement of said rollers with the plank will not exert sufficient pressure on that plant to deform the same.

2. The automatic lumber planing machine of claim 1, further including a drive means mounted on the machine body and having a sprocket chain attached thereto, said sprocket chain being attached to one of said conveyor rollers to drive said roller in rotary motion, a sprocket gear on the other conveyor roller, and a second sprocket chain attaching said one conveyor roller to said other conveyor roller sprocket gear so that as said first conveyor roller is rotationally driven by said drive means said other conveyor roller is driven in the same direction and at the same speed by said second sprocket chain.

3. The automatic lumber planing machine of claim 2, further including a roller shaft in each of said roller housings, an arm having one end thereof pivotally secured to said stationary member and the other end thereof secured to one of said roller shafts, and a plurality of connecting bars each pivotally attached at each end to a roller housing to prevent movement of said roller housing left or right of the axis of said planing table.

4. The automatic lumber planing machine of claim 3, further including a handwheel attached to each movable roller housing, and a rod connecting each handwheel to a corresponding roller so that movement of said handwheel causes movement of said conveyor roller via movement of said roller housing.

5. The automatic lumber planing machine of claim 4, further including a pressure plate assembly and a connecting rod connecting said pressure plate assembly to one of said handwheels so that movement of said handwheel is transmitted to said pressure plate assembly via said connecting rod.

6. The automatic lumber planing machine of claim 5, wherein said pressure plate assembly includes a base and a plurality of pressure plates connected to said base, each pressure plate having a cushioning member thereon with said cushioning members each including cushioning material located between said each pressure plate and said base.

* * * * *